US008544595B2

(12) United States Patent
Suzuki et al.

(10) Patent No.: US 8,544,595 B2
(45) Date of Patent: Oct. 1, 2013

(54) CARBONACEOUS ACOUSTIC DIAPHRAGM AND METHOD FOR MANUFACTURING THE SAME

(75) Inventors: Takeshi Suzuki, Fujioka (JP); Atsunori Satake, Fujioka (JP); Noboru Kanba, Fujioka (JP); Akihito Mitsui, Yokohama (JP); Yoshihisa Suda, Tokyo (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 0 days.

(21) Appl. No.: 13/133,360

(22) PCT Filed: Dec. 8, 2009

(86) PCT No.: PCT/JP2009/070793

§ 371 (c)(1),
(2), (4) Date: Jun. 7, 2011

(87) PCT Pub. No.: WO2010/071090

PCT Pub. Date: Jun. 24, 2010

(65) Prior Publication Data

US 2011/0240401 A1 Oct. 6, 2011

(30) Foreign Application Priority Data

Dec. 18, 2008 (JP) ..... 2008-322992
Dec. 26, 2008 (JP) ..... 2008-335258

(51) Int. Cl.
*G10K 13/00* (2006.01)

(52) U.S. Cl.
USPC ..... 181/167

(58) Field of Classification Search
USPC ..... 181/167
See application file for complete search history.

(56) References Cited

U.S. PATENT DOCUMENTS

| | | | | |
|---|---|---|---|---|
| 4,129,195 | A * | 12/1978 | Ishii et al. | 181/167 |
| 4,478,309 | A * | 10/1984 | Kawamura et al. | 181/167 |
| 5,080,743 | A * | 1/1992 | Odajima | 156/243 |
| 6,543,573 | B2 * | 4/2003 | Ishihara et al. | 181/167 |
| 2002/0027040 | A1 * | 3/2002 | Sato et al. | 181/167 |
| 2005/0211499 | A1 * | 9/2005 | Schwarzenberg et al. | 181/167 |
| 2006/0266577 | A1 * | 11/2006 | Inoue et al. | 181/167 |

FOREIGN PATENT DOCUMENTS

| | | |
|---|---|---|
| JP | 62163494 | 7/1987 |
| JP | 01185098 | 7/1989 |
| JP | 04261299 | 9/1992 |
| JP | 05022790 | 1/1993 |
| JP | 2002171593 | 6/2002 |
| JP | 2003165784 | 6/2003 |
| JP | 2004032425 | 1/2004 |
| WO | WO 2010/071090 | 6/2010 |

OTHER PUBLICATIONS

Serial No. PCT/JP2009/070793 International Search Report mailed Jan. 12, 2010, 2 pages.

* cited by examiner

*Primary Examiner* — Forrest M Phillips
(74) *Attorney, Agent, or Firm* — Andrew F. Young, Esq.; Lackenbach Siegel, LLP

(57) ABSTRACT

A carbonaceous acoustic diaphragm whose density is reduced while retaining the required stiffness is provided. Carbon nanofibers and spherical particles of PMMA are mixed into a carbon-containing resin such as a polyvinyl chloride resin, and the mixture is carbonized to vaporize the spherical particles of PMMA, thereby forming a porous structure having pores with the carbon nanofibers in a powdered form uniformly dispersed through amorphous carbon. By forming a multilayer structure by combining the porous layer with a layer that does not use PMMA, the density can be further reduced while retaining the stiffness.

6 Claims, 2 Drawing Sheets

CARBONACEOUS ACOUSTIC DIAPHRAGM AND METHOD FOR MANUFACTURING THE SAME

CROSS REFERENCE TO RELATED APPLICATIONS

This application claims priority from PCT/JP2009/070793 filed on Dec. 8, 2009, which in turn claims priority from Japanese App. Ser. No. 2008-322992 filed Dec. 18, 2008 and Japanese App. Ser. No. 2008-335258 filed Dec. 26, 2008, the entire contents of each of which is herein incorporated fully by reference.

FIGURE FOR PUBLICATION

FIG. 1.

BACKGROUND OF THE INVENTION

1. Field of the Invention

The present invention relates to a carbonaceous acoustic diaphragm and a method for manufacturing the same.

2. Description of the Related Art

The diaphragm of a speaker used in various kinds of audio or video equipment or mobile equipment such as mobile telephones is required to have faithfully reproduce clear sound over a wide range of frequencies, especially, in the high frequency range. Accordingly, the material for the diaphragm must be chosen to satisfy two apparently conflicting properties: high elasticity for providing sufficient stiffness to the diaphragm and low density for reducing the weight of the diaphragm. In particular, in the case of a diaphragm used in digital speakers which have come to attract attention in recent years, the above properties are necessary because of the need for improved vibration response.

In patent documents 1 and 2 cited below, a diaphragm formed from a material produced by uniformly dispersing carbon nanofibers (vapor-grown carbon fibers) and graphite through amorphous carbon is disclosed. However, since the density of this material is as high as 1.0 mg/cm$^3$ or more, in order to achieve the desired acoustic characteristics there is a need to enhance the elastic modulus by increasing the amount of the costly carbon nanofibers and graphite used, and there is also a need to reduce the thickness. This gives rise to the problem that the diaphragm may break during handling, etc., and a problem also arises in terms of productivity.

Patent document 3 discloses a method in which resin powder, which is baked (carbonized) to form glass-like carbon (amorphous carbon), is first heated and spot-fused to form a porous structure which is then carbonized to produce a low-density porous amorphous carbon structure. However, with this method, it is difficult to obtain a porous structure having a high porosity of 40% or higher, and it is not possible to obtain a diaphragm having an overall density of 1.0 g/cm$^3$ or less.

Patent document 4 discloses a carbonaceous acoustic diaphragm fabricated by vapor phase deposition of pyrolytic carbon on a resin-impregnated and carbonized nonwoven or woven carbon fiber fabric. With this method also, it is difficult to obtain a porous structure having a high porosity of 40% or higher.

Patent document 5 discloses an acoustic diaphragm fabricated by etching the surface of a foamed graphite film and impregnating it with plastic. The foamed graphite here refers to the state produced by disrupting the graphite's unique layered structure by gases formed when carbonizing the polymer at high temperatures, and it is difficult to design and control the porosity as desired. Therefore, by impregnating the resin into the foamed graphite and thereby reinforcing the partially thinned defective portions of the graphite, it is attempted to achieve a flat reproduction frequency response; that is, the main purpose is to reinforce the defective portions of the graphite by the resin. Furthermore, since the resin is impregnated by etching the surface, the process is complex, and the process management also tends to become complex.

RELATED ART DOCUMENTS

Patent Documents

Patent document 1: Japanese Unexamined Patent Publication No. 2004-32425 (Patent No. 3630669)
Patent document 2: Japanese Unexamined Patent Publication No. 2002-171593
Patent document 3: Japanese Unexamined Patent Publication No. H01-185098
Patent document 4: Japanese Unexamined Patent Publication No. S62-163494
Patent document 5: Japanese Unexamined Patent Publication No. H05-22790

ASPECTS AND SUMMARY OF THE INVENTION

Problem to be Solved by the Invention

It is accordingly an aspect of the present invention to provide a carbonaceous acoustic diaphragm that has sufficient stiffness despite its low density and light weight, that exhibits good acoustic characteristics, and that can be manufactured industrially at low cost, and a method for manufacturing such an acoustic diaphragm.

Means for Solving the Problem

According to the present invention, there is provided a carbonaceous acoustic diaphragm which is constructed from a porous structure having a porosity of 40% or higher and comprising amorphous carbon and carbon powder uniformly dispersed through the amorphous carbon.

Advantageously, the carbonaceous acoustic diaphragm includes a low-density layer formed from a plate of the porous structure, and further includes a high-density layer comprising amorphous carbon and having a smaller thickness than the low-density layer and a higher density than the low-density layer.

Various layered structures are possible in terms of the number of layers; for example, a two-layered structure comprising a high-density layer and a low-density layer, or a three-layered structure in which a low-density layer is sandwiched between high-density layers or, conversely, a high-density layer is sandwiched between low-density layers.

Preferably, pores formed in the porous structure are spherical in shape, and their number-average pore diameter is not smaller than 5 μm but not larger than 150 μm. Also preferably, the carbon powder includes carbon nanofibers whose number-average diameter is not larger than 0.2 μm and whose average length is not longer than 20 μm. The high-density layer may contain graphite uniformly dispersed through the amorphous carbon. Preferably, the carbonaceous acoustic diaphragm has the property that when left in an environment at a temperature of 25° C. and a relative humidity of 60% for 250 hours after drying, an increase in mass is 5% or less.

According to the present invention, a method for manufacturing a carbonaceous acoustic diaphragm by carbonizing a carbon precursor in an inert atmosphere, the carbon precursor being produced by uniformly mixing carbon powder into a carbon-containing resin and by molding the mixture into a film-like shape and heating the film is provided, the method comprising: premixing the mixture with particles of a pore-forming material which is a solid or liquid at a temperature used to produce the carbon precursor and which is vaporized to leave pores at a temperature used for the carbonization, and thereby forming a porous structure containing amorphous carbon and carbon powder after the carbonization.

Advantageously, the method further includes forming a carbon-containing resin layer on at least one side of the carbon precursor plate before the carbonization, and thereby forming as a result of the carbonization a carbonaceous acoustic diaphragm comprising a low-density layer formed from the porous structure and a high-density layer having a higher density than the low-density layer. Here, the structure in which a high-density layer is sandwiched between low-density layers can be obtained, for example, by integrally bonding by means of a resin a carbon precursor layer containing a pore-forming material to each side of a carbon precursor layer not containing a pore-forming material and by carbonizing the integrally bonded structure.

Preferably, the particles of the pore-forming material are spherical in shape. Also preferably, the carbon powder includes carbon nanofibers. The carbon-containing resin layer may contain graphite uniformly dispersed therethrough. Preferably, the carbonization is performed at a temperature not lower than 1200° C.

Effect of the Invention

When the particles of the pore-forming material, for example, polymethyl methacrylate (PMMA), which is a solid or liquid at the temperature used to produce the carbon precursor and which is vaporized to leave pores at carbonization temperature, are mixed into the mixture of the carbon-containing resin and the carbon powder, the pore-forming material is vaporized during the carbonization process, leaving three-dimensionally shaped pores corresponding to the three-dimensional shape of each particle. Accordingly, the porosity can be easily controlled by controlling the mixing ratio of the pore-forming material, and the three-dimensional shape and size of the pores can be easily controlled by suitably selecting the three-dimensional shape and size of the particles of the pore-forming material. The porous structure having a porosity of 40% or higher can thus be achieved.

The porosity here is defined as the percentage of the volume of the pores relative to the volume of the entire porous structure containing the pores, and is calculated from the volume and mass of the entire porous structure by assuming that the carbon density is 1.5 g/cm$^3$.

When the low-density layer formed from the above porous structure is combined with the high-density layer thus forming a composite structure, a porosity of 60% or higher can be achieved, while retaining the required stiffness, and the overall density of the diaphragm can be reduced to 0.5 g/cm$^3$ or lower.

The intended effectiveness of the high-density layer can be achieved when its thickness is about 1 to 30% of the total thickness, and the stiffness equivalent to Young's modulus of about 100 GPa contributes to sound reproduction in the high frequency range.

The low-density layer, whose Young's modulus is about 2 to 3 GPa, serves to reduce the overall weight of the diaphragm, to maintain sound quality as a whole, and to improve vibration response.

Since these layers are combined into a single integral structure which is then baked and carbonized, a multilayer flat speaker diaphragm can be achieved that can control its characteristics and that can reproduce sound over the audible range, especially, up to the high-frequency end thereof.

The flat diaphragm enhances the frequency response at the high-frequency end by the balance between the high-density layer of the highly compacted stiff structure and the beam strength of the lightweight low-density layer that serves as the core, rather than conferring stiffness by providing a domed structure as described in the earlier cited patent documents 1 and 2. The sound reproduction range varies depending on the porosity design, but is relatively unaffected by the porosity diameter. Handling is facilitated, and impact resistance also improves. Further, by covering one or both sides of the low-density porous layer by the high-density layer, it is possible to prevent adhesive from being drawn inside when assembling the diaphragm into the unit.

Another property required of the acoustic diaphragm is low moisture absorption in order to prevent the acoustic characteristics from changing due to a change in weight by absorbing moisture in the air. As will be described later, by setting the carbonizing temperature to 1200° C. or higher, a diaphragm can be obtained in which the change in mass is held to 5% or less when left in an environment at a temperature of 25° C. and a relative humidity of 60% for 250 hours after drying.

DETAILED DESCRIPTION OF THE PREFERRED EMBODIMENTS

Figure 1:
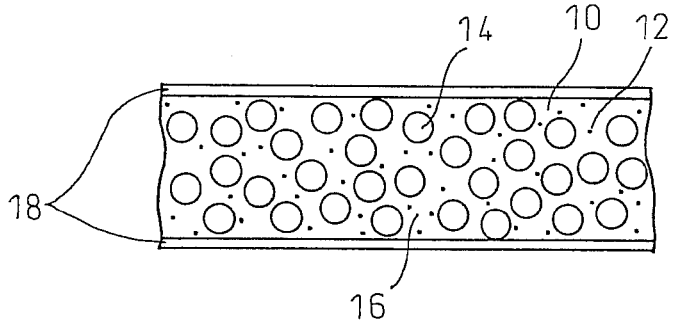
FIG. 1 is a diagram conceptually showing a cross section of an acoustic diaphragm obtained in working example 1.

Reference will now be made in detail to several embodiments of the invention that are discussed herein. Wherever possible, same or similar reference numerals are used in the drawings and the description to refer to the same or like parts or steps. The drawings are in simplified form and are not to precise scale

WORKING EXAMPLES

Working Example 1

A diallyl phthalate monomer was added as a plasticizer to a composition made up of 35% by mass of polyvinyl chloride as an amorphous carbon source, 1.4% by mass of carbon nanofibers having an average particle diameter of 0.1 μm and a length of 5 μm, and PMMA as a pore-forming material for forming pores, and was dispersed therein by using a Henschel mixer; after that, the mixture was repeatedly and thoroughly kneaded by using a pressure kneader and pelletized by a pelletizer to obtain a molding composition. The molding composition in pellet form was molded by extrusion molding into the shape of a sheet of thickness 400 μm, both sides of which were then coated with a furan resin and cured to form a multilayer sheet. The multilayer sheet was treated for five hours in an air oven held at 200° C., to produce a precursor (carbon precursor). After that, the resulting material was heated in a nitrogen gas atmosphere by raising the temperature at a rate of 20° C. per hour until reaching 1000° C. at which the material was held for three hours. After allowing the material to cool down by itself, the material was held at 1400° C. for three hours in a vacuum and thereafter left to cool down by itself, to complete the baking process. Thus, as conceptually illustrated in FIG. 1, an acoustic diaphragm was obtained that comprised a low-density porous layer 16, in which the carbon nanofibers 12 in a powdered form were uniformly dispersed through the amorphous carbon 10 and spherical pores 14 were left after vaporizing the PMMA particles, and high-density layers 18 of amorphous carbon covering the upper and lower surfaces of the low-density layer 16.

The porosity of the low-density layer 16 in the thus obtained acoustic diaphragm was 70%, and the number-average pore diameter was 60 μm. The diaphragm as a whole exhibited excellent physical properties, having a thickness of about 350 μm, bending strength of 25 MPa, Young's modulus of 8 GPa, acoustic velocity of 4200 msec, density of 0.45 g/cm$^3$, and moisture absorption of 1% by mass or less.

Figure 2:
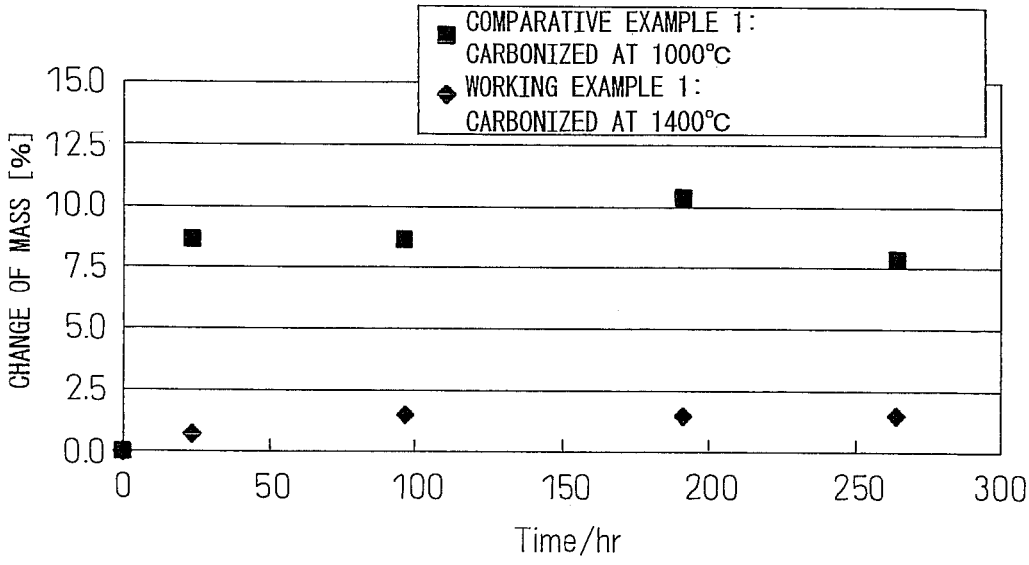
FIG. 2 is a graph illustrating the relationship between carbonizing temperature and moisture absorption.

The acoustic velocity and the density were obtained by calculation from the measured value of the Young's modulus (the same applies hereinafter). The moisture absorption was obtained by measuring an increase in mass (%) when the material, after drying at 100° C. for 30 minutes, was left in an environment at a temperature of 25° C. and a relative humidity of 60%. FIG. 2 shows the relationship between the elapsed time and the change of mass. As comparative example 1, results are also shown when the baking (carbonizing) temperature at the end of the process was set to 1000° C. As can be seen from FIG. 2, by setting the carbonizing temperature to 1200° C. or higher, a diaphragm can be obtained that has a low moisture absorption rate, the increase in mass after 250 hours being held to 5% or less.

Figure 3:
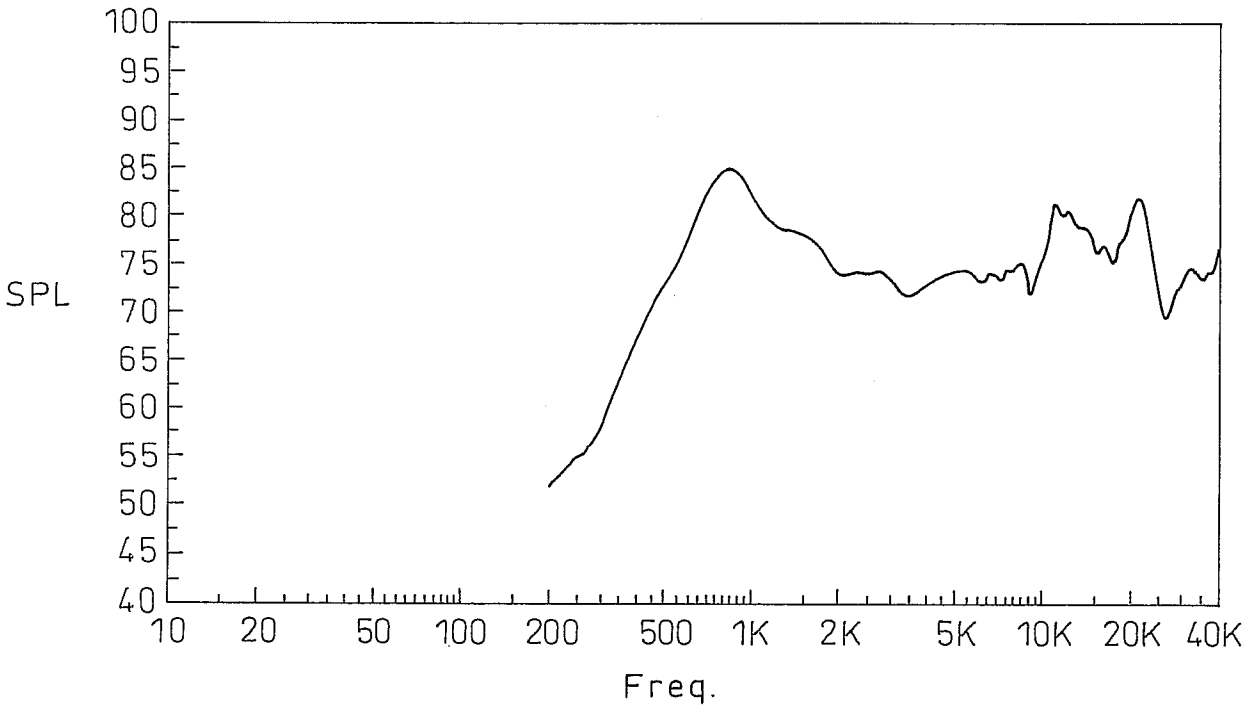
FIG. 3 is a graph showing the acoustic characteristics of the diaphragm obtained in working example 1.

FIG. 3 shows the frequency characteristic of a speaker fabricated using the thus obtained diaphragm. It is seen that a substantially flat frequency characteristic is obtained up to 40 kHz or higher frequencies beyond 20 kHz which is the highest frequency that the human ear can normally hear.

Working Example 2

An Example in which a Filler (Graphite) was Introduced into the High-Density Layer A diallyl phthalate monomer was added as a plasticizer to a composition made up of 35% by mass of polyvinyl chloride as an amorphous carbon source, 1.4% by mass of carbon nanofibers having an average particle diameter of 0.1 μm and a length of 5 μm and PMMA as a pore-forming material for forming pores, and was dispersed therein by using a Henschel mixer; after that, the mixture was repeatedly and thoroughly kneaded by using a pressure kneader and pelletized by a pelletizer to obtain a molding composition. The molding composition in pellet form was molded by extrusion molding into the shape of a sheet of thickness 400 μm, both sides of which were then coated with a liquid prepared by dispersing, through a furan resin, 5% by mass of graphite (SP270 manufactured by Nippon Graphite) having an average particle diameter of about 4 μM and by adding a curing agent, and cured to form a multilayer sheet. The multilayer sheet was treated for five hours in an air oven held at 200° C., to produce a precursor (carbon precursor). After that, the resulting material was heated in a nitrogen gas atmosphere by raising the temperature at a rate of 20° C. per hour until reaching 1000° C. at which the material was held for three hours. After allowing the material to cool down by itself, the material was maintained at 1500° C. for three hours in a vacuum and thereafter left to cool down by itself, thus completing the baking process to obtain a composite carbonaceous diaphragm.

The porosity of the low-density layer in the thus obtained acoustic diaphragm was 70%, and the number-average pore diameter was 60 μm. The diaphragm as a whole exhibited excellent physical properties, having a thickness of about 350 μm, bending strength of 23 MPa, Young's modulus of 5 GPa, acoustic velocity of 3333 m/sec, and density of 0.45 g/cm$^3$.

Working Example 3

Formation of a Single-Layer Molding Having a Porosity of 50%

A diallyl phthalate monomer was added as a plasticizer to a composition made up of 54% by mass of polyvinyl chloride as an amorphous carbon source, 1.4% by mass of carbon nanofibers having an average particle diameter of 0.1 μm and a length of 5 μm, and PMMA as a pore-forming material for forming pores, and was dispersed therein by using a Henschel mixer; after that, the mixture was repeatedly and thoroughly kneaded by using a pressure kneader and pelletized by a pelletizer to obtain a molding composition. The pellets were molded by extrusion molding into the shape of a film of thickness 400 μm. The film was treated for five hours in an air oven superheated at 200° C., to produce a precursor (carbon precursor). After that, the resulting material was heated in a nitrogen gas atmosphere by raising the temperature at a rate not faster than 20° C. per hour until reaching 1000° C. at which the material was held for three hours. After allowing the material to cool down by itself, the material was maintained at 1500° C. for three hours in a vacuum and thereafter left to cool down by itself, thus completing the baking process to obtain a composite carbonaceous diaphragm.

The porous acoustic diaphragm thus obtained exhibited excellent physical properties, having a porosity of 50%, pore diameter of 60 μm, thickness of about 350 μm, bending strength of 29 MPa, Young's modulus of 7 GPa, acoustic velocity of 3055 m/sec, and density of 0.75 g/cm$^3$.

Table 1 summarizes the characteristics of the diaphragms obtained in working examples 1 to 3. As can be seen from Table 1, when the porous structure is used alone, a certain degree of density has to be provided in order to secure the necessary strength, but when the structure is reinforced with a high-density layer, the overall density can be reduced by increasing the porosity to 60% or higher while retaining the necessary strength.

While the invention has been described above with reference to working examples, the multilayer structure is not limited to those given in the working examples, and it will be appreciated that the intended effect can also be achieved with various other multilayer structures such as a multilayer structure containing a high-density layer in the interior thereof or a multilayer structure alternating between high-density layers and low-density layers.

As described above, the all-carbonaceous flat speaker diaphragm according to one embodiment of the present invention, which is constructed from a composite multilayer structure comprising low-density and high-density layers, exhibits the properties of light weight and high stiffness, achieves a faster acoustic propagation velocity and a higher frequency reproduction range, allows the industrial use of various shape forming means, and has excellent industrial mass-producibility. Accordingly, when applied, among others, as an analog speaker diaphragm or digital speaker diaphragm that can be implemented in a space-saving design for use in various kinds of audio or video equipment or mobile equipment, such as mobile telephones, the diaphragm can achieve high quality sound reproduction over a wide frequency range from low frequencies to high frequencies.

| | POROSITY (%) | BENDING STRENGTH (MPa) | YOUNG'S MODULUS (GPa) | ACOUSTIC VELOCITY (m/sec) | DENSITY (g/cm$^3$) |
|---|---|---|---|---|---|
| WORKING EXAMPLE 1 (THREE-LAYERED STRUCTURE) | 70 | 25 | 8 | 4,200 | 0.45 |
| WORKING EXAMPLE 2 (GRAPHITE FILLED INTO HIGH-DENSITY LAYER) | 70 | 23 | 5 | 3,333 | 0.45 |
| WORKING EXAMPLE 3 (POROUS STRUCTURE ALONE) | 50 | 29 | 7 | 3,055 | 0.75 |

The invention claimed is:

1. A carbonaceous acoustic diaphragm, comprising amorphous carbon obtained by a carbonization process of a carbon-containing resin and carbon powder uniformly dispersed through said amorphous carbon, wherein said carbonaceous acoustic diaphragm is constructed from a porous structure having a porosity of 40% or higher wherein porous of said porous structure have been formed by particles of pore-forming material, which are vaporized during process of said carbonization to leave three-dimensionally shaped pores corresponding to three-dimensional shapes thereof; and number-average pore diameter of pores of said porous structure is 5-150 μm.

2. A carbonaceous acoustic diaphragm according to claim 1, comprising:

a low-density layer comprising amorphous carbon and carbon powder uniformly dispersed through said amorphous carbon, wherein said low-density layer is formed from a porous structure having a porosity of 40% or higher; and a high-density layer comprising amorphous carbon, wherein said high-density layer has a smaller thickness than said low-density layer and a higher density than said low-density layer.

3. A carbonaceous acoustic diaphragm according to claim 1, wherein pores formed in said porous structure are spherical in shape, and said porous structure is formed from the carbonization of polymethyl methacrylate.

4. A carbonaceous acoustic diaphragm according to claim 1, wherein said carbon powder includes carbon nanofibers.

5. A carbonaceous acoustic diaphragm according to claim 2, wherein said high-density layer contains graphite uniformly dispersed through said amorphous carbon.

6. A carbonaceous acoustic diaphragm according to claim 1, wherein when left in an environment at a temperature of 25° C. and a relative humidity of 60% for 250 hours after drying, an increase in mass is 5% or less.

* * * * *